US005938497A

United States Patent [19]

Mott

[11] Patent Number: 5,938,497

[45] Date of Patent: Aug. 17, 1999

[54] CONSTRUCTIONAL TOYS

[75] Inventor: Jonathan Christopher Mott, Farnham, United Kingdom

[73] Assignee: Morphun Research Limited, London, United Kingdom

[21] Appl. No.: 08/981,023

[22] PCT Filed: Jun. 19, 1996

[86] PCT No.: PCT/GB96/01496

§ 371 Date: Dec. 29, 1997

§ 102(e) Date: Dec. 29, 1997

[87] PCT Pub. No.: WO97/01383

PCT Pub. Date: Jan. 16, 1997

[30] Foreign Application Priority Data

Jun. 26, 1995 [GB] United Kingdom ..... 9512970
Oct. 6, 1995 [GB] United Kingdom ..... 9520472

[51] Int. Cl.[6] ..... A63H 33/04; A63H 33/08

[52] U.S. Cl. ..... 446/122; 446/85; 446/124; 446/128

[58] Field of Search ..... 446/85, 105, 106, 446/107, 108, 111, 112, 116, 122, 124, 127

[56] References Cited

U.S. PATENT DOCUMENTS

| | | | |
|---|---|---|---|
| 1,281,856 | 10/1918 | Shaw | 446/112 |
| 1,286,462 | 12/1918 | Wesche | 446/122 |
| 3,513,589 | 5/1970 | Fischer | 446/127 |
| 3,571,965 | 3/1971 | Gibb | 446/105 |
| 4,115,980 | 9/1978 | Martel et al. | 52/590.2 |
| 4,547,160 | 10/1985 | Labelle | 434/195 |
| 4,648,226 | 3/1987 | Manon | 52/308 |
| 5,137,486 | 8/1992 | Glickman | 446/126 |
| 5,788,555 | 8/1998 | Glynn | 446/124 |

FOREIGN PATENT DOCUMENTS

| | | | |
|---|---|---|---|
| 596752 | 10/1925 | France | 446/127 |
| 531754 | 1/1941 | United Kingdom | 446/127 |

*Primary Examiner*—Robert A. Hafer
*Assistant Examiner*—Michael B. Priddy
*Attorney, Agent, or Firm*—Jacobson, Price, Holman & Stern, PLLC

[57] ABSTRACT

A constructional toy including a plurality of main building blocks, preferably square and triangular in shape, all having identical grooves in their side faces, the mouth of each groove being narrower than the rest of the groove. The blocks are connected together by connecting elements each having a cross section in the shape of a symmetrical star having 2N points, where N is at least three. Each connecting element is a sliding fit in the grooves in the main blocks, with N adjacent points of its star-shaped cross section trapped in the groove and the other N points outside the groove, thus enabling the blocks to be connected together side face to side face.

26 Claims, 6 Drawing Sheets

CONSTRUCTIONAL TOYS

This invention relates to constructional toys, and is more particularly concerned with improvements to constructional toys of the kind disclosed in United Kingdom Patent Specifications Nos 2 224 953 and 2 271 297.

The constructional toys disclosed in both of the aforementioned United Kingdom patent specifications comprise main building elements in the form of square-section and triangular-section blocks having flat side surfaces, the blocks being joined together side-to-side by connecting elements which slide into grooves, narrower at the mouth than in the remainder of the groove, provided in the side surfaces of the blocks. In the former of the aforementioned United Kingdom patent specifications, the connecting elements are of double dovetail-shaped cross-section and each groove is dovetail-shaped in section, while in the latter, the connecting elements have a cross-section in the shape of a symmetrical four pointed star and each groove has a cross-section shaped to receive two adjacent points of the star shaped cross-section of the connecting element.

By virtue of the cross-sectional shape of its connecting elements, the constructional toy of the latter patent specification is more versatile than the constructional toy of the former specification, in that the main building elements can be connected to the connecting elements in a greater number of relative orientations. However, to achieve easy but fairly tight connection between the main building elements and the connecting elements, the elements must be manufactured, ie moulded, to very tight dimensional tolerances, which can be difficult and/or expensive. Also, the connecting elements need to be accurately aligned with the grooves in the main building elements when connecting the elements together, which can be difficult for young children. It is an object of the present invention to alleviate one or more of these difficulties.

According to the present invention, there is provided a constructional toy comprising a plurality of elements of at least two different types which can be assembled together to form a variety of three-dimensional structures, said elements including:

- a main element in the form of a building block having a plurality of flat side surfaces, at least one of said surfaces having a groove therein, said groove having a mouth narrower than the remainder thereof; and
- an elongate connecting element having a cross-section in the shape of a symmetrical star having 2N points, where N is an integer not less than three, said connecting element being a sliding fit in said groove, with any N adjacent points of its star-shaped cross-section trapped in the groove and the other N points disposed outside the groove.

In a preferred embodiment of the invention, each connecting element is hollow, with its internal cross-section preferably being generally similar to its external cross-section, whereby to render the connecting elements at least slightly crushable.

Advantageously, the opposite ends of each connecting element are slightly tapered, and/or the ends of the grooves in each main element are slightly flared (ie progressively increase in cross-sectional area with respect to the main part of the groove).

Each of the abovementioned features of the invention contributes to easier insertion of the connecting elements into the grooves in the main elements, and/or to less demanding dimensional tolerances in the manufacturing process, typically moulding, used to produce the elements.

Advantageously, N is six, although embodiments of the invention in which N is four or even three are possible.

Preferably, each groove is shaped to be substantially complementary in cross-section to the cross-sectional shape of any N adjacent points of the star-shaped cross-section of the connecting element.

Conveniently, each main element has first and second substantially planar, parallel, ends which are interconnected by said side surfaces. Further, each of said side surfaces preferably extends perpendicularly to said ends.

Preferably, each main element has a cross-section, perpendicular to said side surfaces, in the shape of a rectangle or a regular polygon: in the latter case, some main elements may be triangular in cross-section, some may be square and some may be hexagonal.

The main elements and connecting elements may be made in a plurality of heights, of which the greater heights are conveniently integral multiples of the smallest height.

Said side surfaces of the triangular, square and hexagonal main elements are preferably all of the same width.

Each main element has at least one cylindrical aperture extending thereinto with its axis parallel to the longitudinal axis of the groove, the diameter of said aperture being such that said connecting element is a tight sliding fit therein.

In the triangular, square and hexagonal main elements, the axis of the cylindrical aperture preferably coincides with the central axis of the element.

In a preferred embodiment of the invention, the main elements are all hollow, with one of said planar ends closed and the other open.

The toy advantageously also includes at least one of several different, more sophisticated, auxiliary connecting elements each based upon a half connecting element constituted by the half of a complete connecting element on one side of a plane which longitudinally bisects the complete connecting element and the respective opposed included angles between opposed pairs of adjacent points of its cross-section. Thus a first auxiliary connecting element may comprise two half connecting elements integrally jointed at the respective midpoints of their respective flat sides and extending at 90° to each other. A second auxiliary connecting element may comprise a single half connecting element having a complete connecting element integrally joined thereto and extending perpendicularly from the midpoint of its flat side. A third auxiliary connecting element may comprise four connecting elements connected together at their ends and extending at right angles to each other in a common plane to form a cross.

Preferably, all the elements are moulded in a suitable plastics material, for example ABS, acrylic plastic, polystyrene or polypropylene.

Alternatively, all the elements may be made from a suitable plastics foam material, such as expanded polyethylene, typically by cutting them from a large sheet of such material, in which case they may be solid rather than hollow.

The invention will now be described, by way of example only, with reference to the accompanying drawings, of which:

Figure 1A:
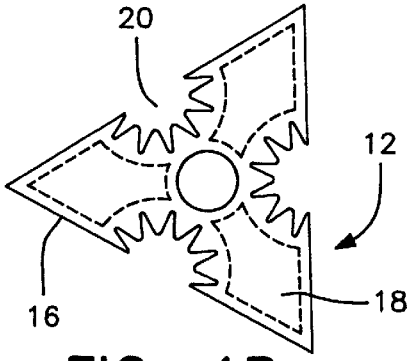
FIGS. 1A to 1C are top, side and bottom views respectively of a triangular main building element forming part of a first embodiment of a constructional toy in accordance with the present invention.

The constructional toy of FIGS. 1 to 4 is similar in a number of ways to the constructional toy of the aforementioned United Kingdom Patent Specification No 2 271 297. In particular, and as described in United Kingdom Patent Specification No 2 271 297, the toy comprises hollow triangular- and square-section building blocks 12, 14 having three or four identical rectangular side surfaces 16 each extending between substantially triangular or square planar top and bottom ends 18, 19 respectively. The top ends 18 are flat and substantially closed, while the bottom ends 19 are open. Each of the side surfaces 16 is provided with an identical groove 20 extending perpendicularly between the top and bottom ends 18, 19 along the middle of the side surface. However, instead of having 25 mm edges, the blocks 12, 14 have 30 mm edges: this increase in size provides increased safety for young children, since is makes the blocks less likely to be swallowed.

As also described in United Kingdom Patent Specification No 2 271 297, the constructional toy of the present invention comprises a plurality of each of the blocks 12, 14, preferably moulded in different colours in a suitable plastics material such as ABS, acrylic plastic, polystyrene or polypropylene, which can be joined together to form a great variety of interesting and/or visually attractive three-dimensional structures, by means of elongate connecting elements moulded in the same plastics material. It is the cross-sectional shape of these connecting elements, and of the grooves 20 into which they are a longitudinal sliding fit, which constitutes one of the principal differences between the constructional toy of the present invention and the constructional toy of United Kingdom Patent Specification No 2 271 297.

Figure 3:
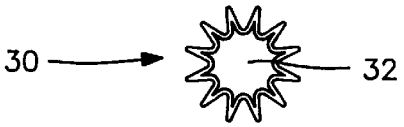
FIG. 3 is a cross-sectional view of a connecting element for use with the main building elements of FIGS. 1 and 2.
Figure 4:
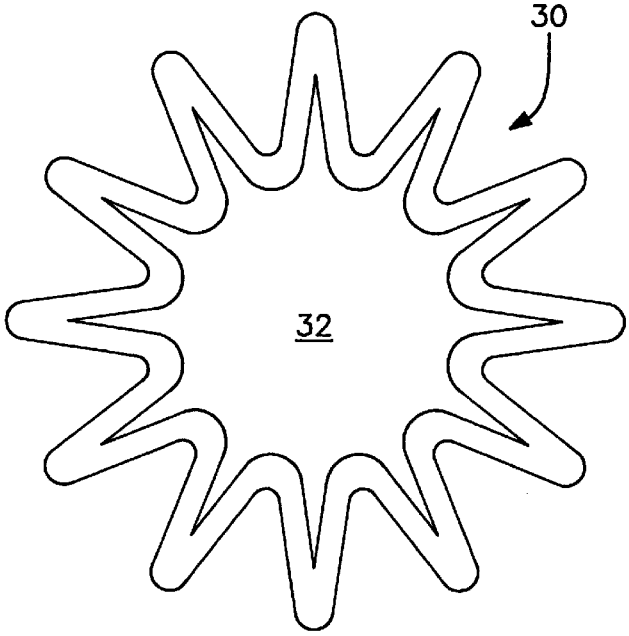
FIG. 4 is an enlarged cross-sectional view of the connecting element of FIG. 3.

Thus the connecting elements of the present invention, which are indicated at 30 in FIGS. 3 and 4, are 30 mm long, and have a cross-section in the shape of a symmetrical twelve pointed star. Correspondingly, the grooves 20 in the main building blocks 12, 14 are each shaped to be substantially complementary in cross-section to the cross-sectional shape of six adjacent points of the star-shaped cross-section of the connecting element 30, ie to half of the cross-sectional shape of the connecting element, as defined by a plane which bisects the angle between opposite pairs of adjacent points.

Figure 2A:
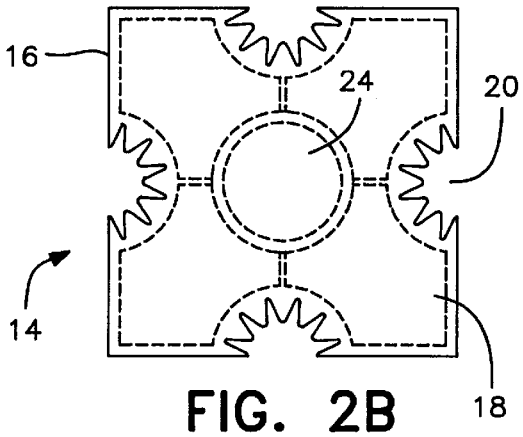
FIGS. 2A to 2C are top, side and bottom views respectively of a square main building element forming another part of the embodiment of the invention of FIG. 1.
Figure 2B:
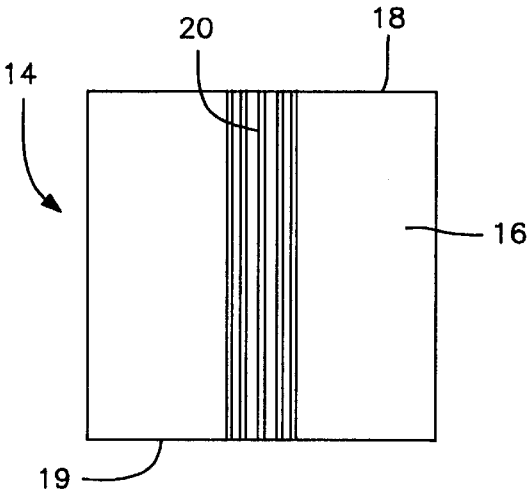
Figure 2C:
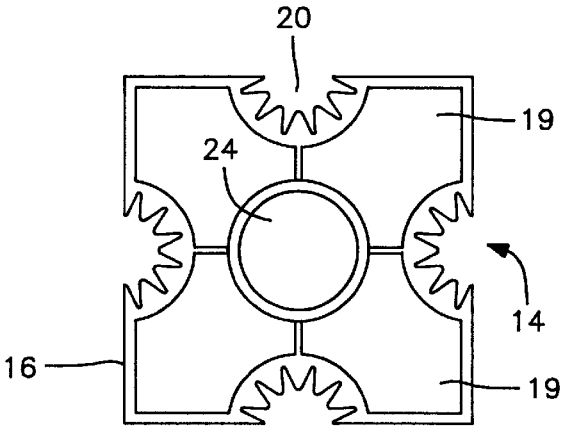

As best seen in FIG. 2, the connecting elements 30 also have hollow interiors, indicated at 32. Each of these hollow interiors 32 has a cross-section shaped to correspond to the twelve pointed star shape of the exterior of the connecting element.

Because there are twelve star points to the cross-sectional shape of the connecting elements 30, the individual points are thinner and therefore more flexible than is the case with only four star points. This increased flexibility is further enhanced by the fact that the connecting elements 30 are hollow, with their hollow interiors 32 shaped to correspond to the exterior shape of the connecting elements, which renders the connecting elements slightly crushable. As a result, the dimensional tolerances on the moulding of the grooves in the main building blocks 12, 14 and on the moulding of the connecting elements 30 are not quite so demanding as is the case with only four star points, since the star points can flex and/or be crushed a little to accommodate slight dimensional mismatches. This accommodation can be further assisted by truncating the crests of the portions of the grooves 20 which correspond to the troughs between the star points of the cross-sectional shape of the connecting elements 30.

Figure 5:
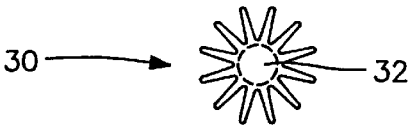
FIG. 5 is a cross-sectional view of an alternative connecting element for a constructional toy in accordance with the present invention.

An alternative shape of the hollow interior 32 of the connecting element 30 is illustrated in FIG. 5: the cross-section is still twelve pointed, but is of reduced area, so that the connecting element is a little less flexible and crushable than the connecting element of FIGS. 3 and 4, but nevertheless retains most of the benefits while being a little more resistant to bending.

Figure 6A:
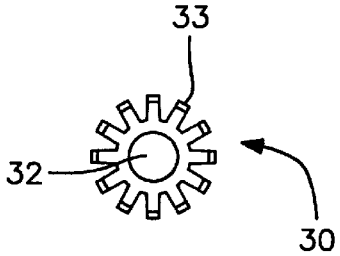
FIGS. 6A and 6B are top and side views respectively of an improved version of the connecting element of FIGS. 3 and 4.
Figure 6B:
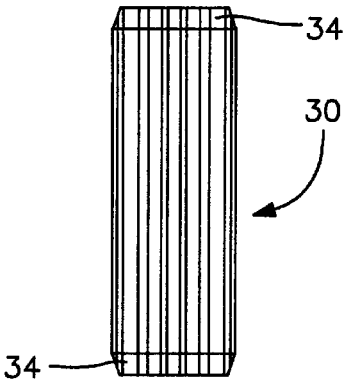

An additional benefit of the twelve pointed star shape of the cross-section of the connecting element 30 is that the element can be inserted into the grooves 20 in the main building blocks 12, 14 in an increased number of different orientations, viz twelve, which increases ease of insertion, especially for young children. This ease of insertion can be further enhanced by slightly tapering the opposite ends of each connecting element 30, and/or by slightly flaring (ie progressively increasing the cross-sectional area of) the opposite ends of each groove 20 in the main building blocks 12, 14: the tapered opposite ends of the connecting element 30 are indicated at 33 in FIGS. 6A and 6B (where the hollow interior 32 is shown as circular in cross-section for the sake of simplicity).

Yet another benefit of the twelve pointed star shape of the cross-section of the connecting element is that is can serve as a gear: typically, a portion of its length, protruding from a groove in a main building block 12 or 14, provides this function.

Figure 7:
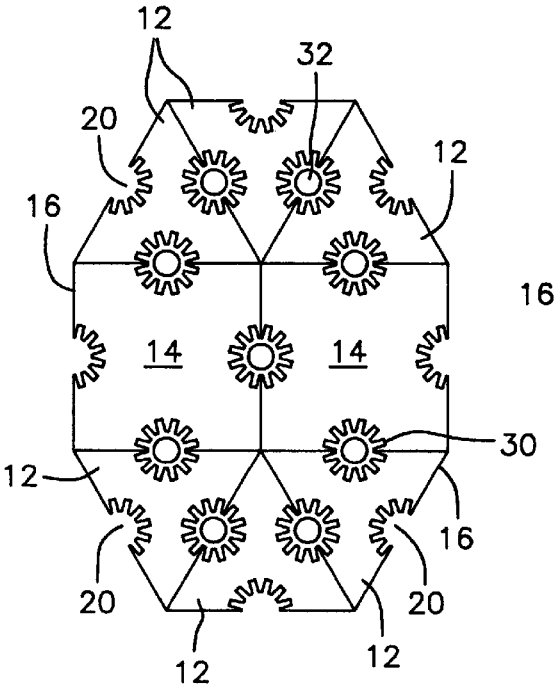
FIG. 7 shows a plurality of main building elements and connecting elements, basically similar to those of FIGS. 1 to 5, connected together.

FIG. 7 shows a plurality of the triangular and square main building elements 12, 14 connected together by the connecting elements 30 to form a larger geometrical shape, the variety of such shapes, both abstract and representational, which can be formed being simply enormous. Again, the hollow interiors 32 of the connecting elements 30 are shown as circular in cross-section for the sake of simplicity.

The connecting element 30 of FIGS. 1 to 5 has twelve star points and a correspondingly shaped, coaxially disposed, hollow interior 32. In the alternative embodiment of FIG. 8, the connecting element, indicated at 34, has a cross-section in the shape of a symmetrical eight pointed star. The grooves 20 in the main building blocks 12, 14 are correspondingly modified. The connecting element 34 again has a hollow interior, indicated at 36, having a cross-section shaped to correspond to the eight pointed star shape of the exterior of the connecting element. As a result, the connecting element 34 is again flexible and slightly crushable, which again eases the dimensional tolerances to which the main building blocks 12, 14 and the connecting elements 34 must be manufactured, ie moulded. However, the connecting element 34 can still be used as a gear, in the same way as the connecting element 30.

Many modifications can be made to the described embodiments of the invention.

For example, in the limit the connecting elements can have as few as six star points, or any greater even number of star points, although twelve star points are currently believed to provide the best results (except in the case of the foam plastics version of the toy, to be described hereinafter).

Furthermore, in addition to the triangular and square blocks 12 and 14, other shapes of main building block can be provided, eg rectangular and hexagonal, and some or all of the main building blocks can be provided with cylindrical apertures which extend wholly or partially through them, parallel to the grooves 20, and which are dimensioned to receive the connecting elements 30 or 34 as a tight sliding fit, generally as described in United Kingdom Patent Specification No 2 271 297. Such apertures are indicated at 24 in FIG. 2, and also at 40 in FIG. 9, which shows at 42 yet another main building element.

Figure 1B:
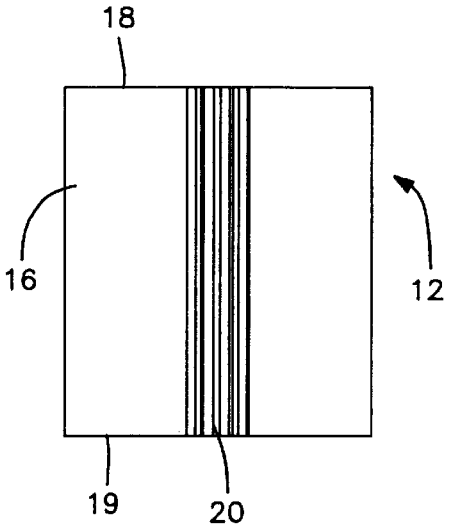
Figure 1C:
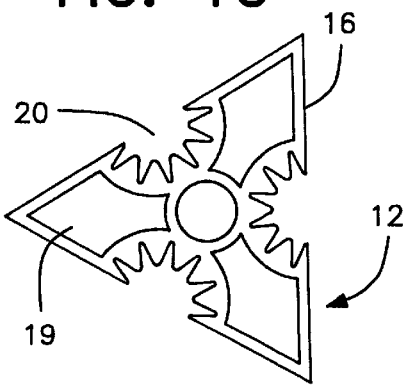
Figure 9A:
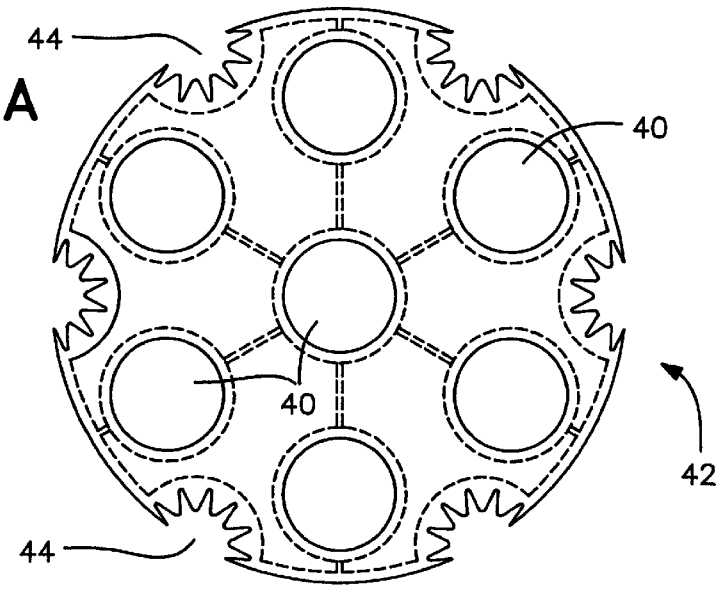
FIGS. 9A to 9C are top, bottom and side views of a circular main building element which can form part of the constructional toy of FIGS. 1 to 4.
Figure 9B:
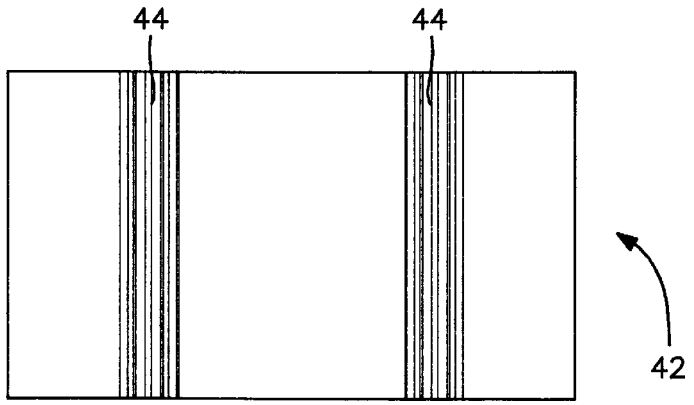
Figure 9C:
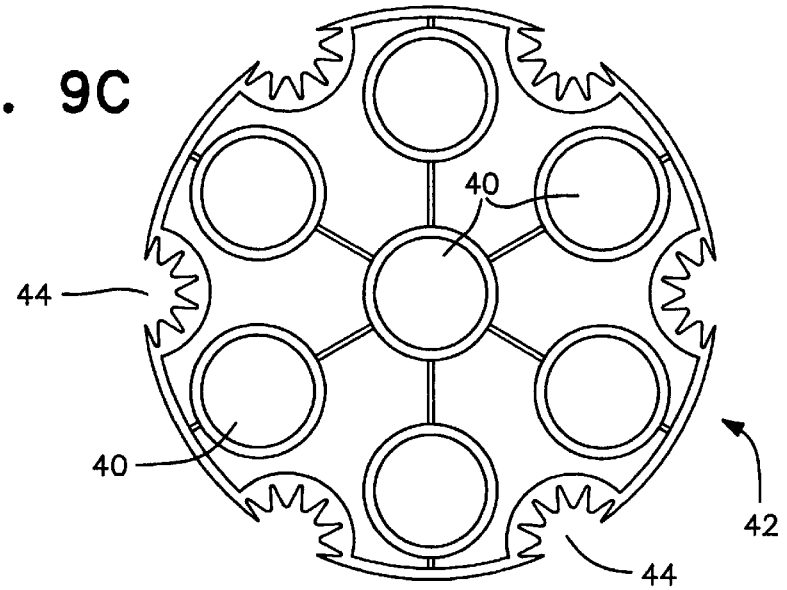

Thus the main building element 42 of FIG. 9 is in the form of a large cylinder of the same height, ie 30 mm, as the triangular and square blocks 12 and 14 of FIGS. 1 and 2. The cylindrical element 42 has six equiangularly spaced grooves 44 in its external surface, extending parallel to its axis and shaped to receive the twelve pointed connecting elements 30 or 34. It also has seven of the apertures 40, one coaxial with it and six equangularly spaced apart around but just inside its circumference, and interleaved between the grooves 44.

Instead of being cylindrical, the apertures 24 and 40 can if desired be substantially complementary in cross-section to the connecting elements 30 or 34.

Figure 8:
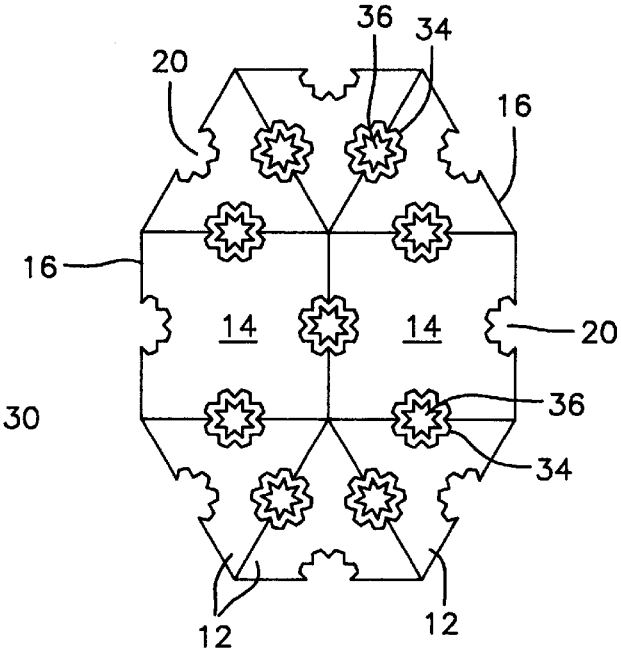
FIG. 8 is a view similar to that of FIG. 6, but showing slightly modified versions of the main building elements and the connecting elements.
Figure 10A:
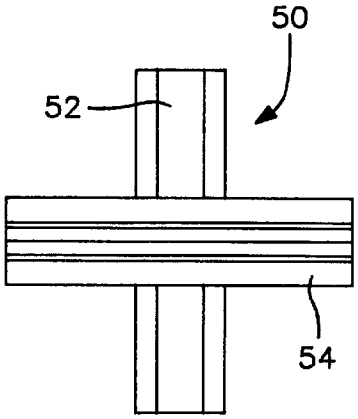
FIGS. 10A to 10C show several different views of a first auxiliary connecting element forming part of a constructional toy in accordance with the present invention.
Figure 10B:
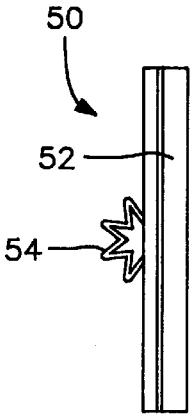
Figure 10C:
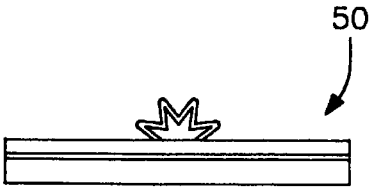
Figure 11A:
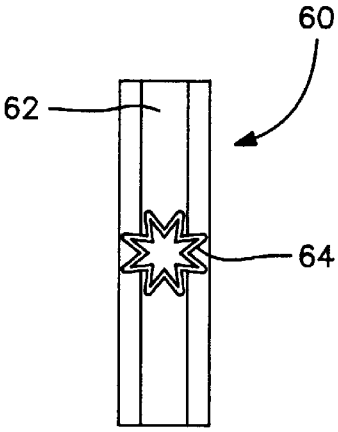
FIGS. 11A to 11C show several different views of a second auxiliary connecting element forming part of a constructional toy in accordance with the present invention.
Figure 11B:
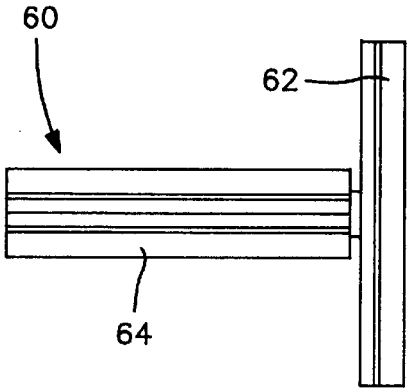
Figure 11C:
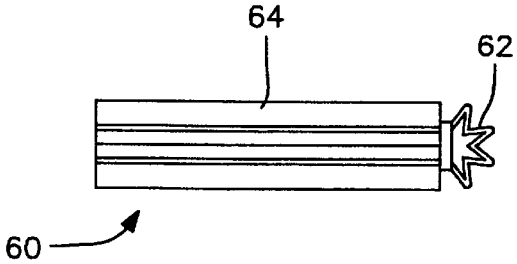
Figure 12A:
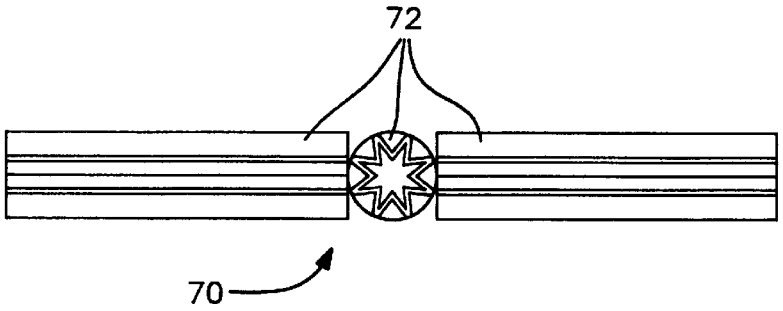
FIGS. 12A to 12C show several different views of a third auxiliary connecting element forming part of a constructional toy in accordance with the present invention.
Figure 12B:
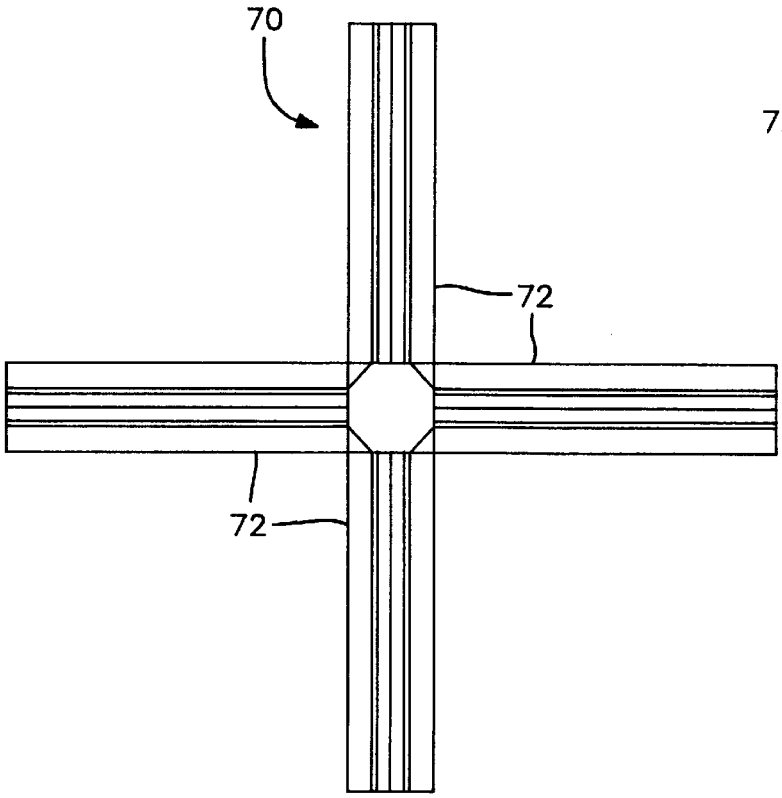
Figure 12C:
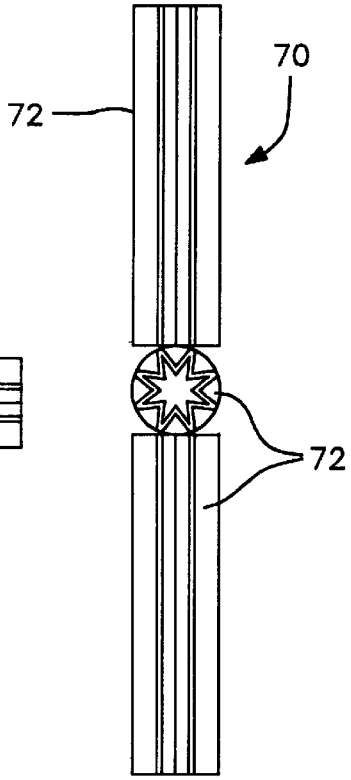

Additionally, the constructional toy of the present invention can include auxiliary connecting elements analogous to those described in United Kingdom Patent Specification No 2 271 297. Three different kinds of such auxiliary connecting elements, based upon the eight pointed connecting elements of FIG. 8, are shown in FIGS. 10 to 12 respectively. Thus in FIG. 10, the auxiliary connecting element is indicated at 50, and comprises two half connecting elements 52, 54 joined together at their flat sides and extending at right angles to each other. In FIG. 11, the auxiliary connecting element is indicated at 60, and comprises a half connecting element 62 having a complete connecting element 64 projecting perpendicularly from the midpoint of its flat side. In FIG. 12, the auxiliary connecting element is indicated at 70, and comprises four complete connecting elements 72 connected to each other at one end and extending perpendicularly to each other in a common plane form a cross.

In another modification, especially suitable for very young children, the triangular and square blocks 12 and 14 and the connecting elements 30 are made larger, typically about 6 cms along each edge, and are made as solid blocks (rather than hollow blocks) in a suitable plastics foam material such as expanded polyethylene. This results in blocks which are very light in weight, fairly stiff in the sense that they hold a well-defined shape, but slightly yielding or crushable. Because the blocks and connecting elements are inherently slightly crushable, the connecting elements, which typically can be six-pointed in cross-section, do not need to be hollow: their inherent crushability achieves the same result. This version of the toy can even be played with in the bath, since the blocks and connecting elements are light enough to float, and the lightness and crushability of the blocks ensure that very young children are most unlikely to hurt each other when playing with them, even if the children throw the blocks about. Typically, the blocks and connecting elements of this form of the toy are made by cutting them from a sheet of the plastics foam material, which sheet can if desired be formed from two sheets of different colours heat bonded together, thereby producing two-coloured blocks and connecting elements and so enabling models and other structures exhibiting striking colour contrasts to be constructed.

Figure 13A:
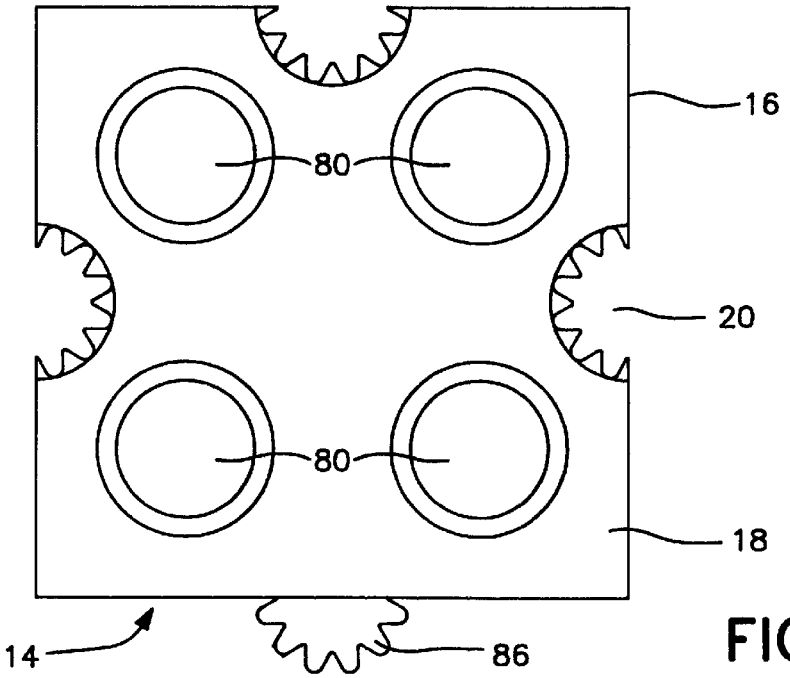
FIGS. 13A and 13B are top and bottom views respectively of an alternative form of square main building element in accordance with the present invention.
Figure 13B:
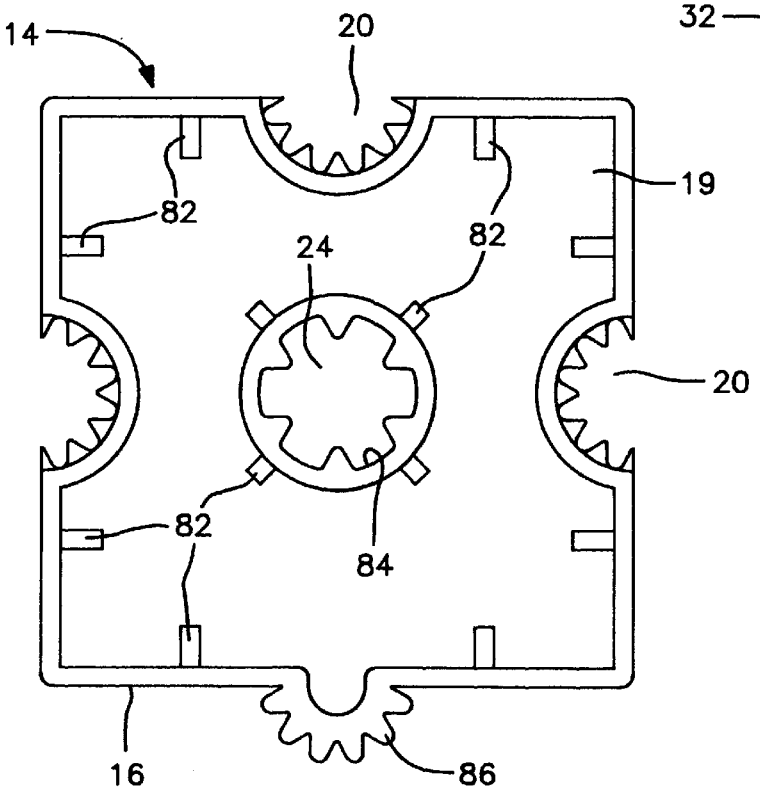

In yet another modification, shown in FIGS. 13A and 13B, the square building blocks 14 are modified by having four upstanding pips 80 moulded on their upper surfaces (see FIG. 13A), these pips being shaped, dimensioned and positioned to enable the blocks to interfit with the corresponding blocks of other widely available brands of constructional toy, eg the toys available under the trade marks LEGO or DUPLO. The hollow underside of the modified block 14 is provided with a number of ribs 82 (see FIG. 13B), which are shaped, dimensioned and positioned to engage the pips 80 of a similar modified block 14. If desired, the opposite ends of the connecting elements 30, 34 can also be provided with pips similar to the pips 80.

Additionally, the central aperture 24 of the modified block of FIG. 13, instead of being either cylindrical or fully complementary in cross-section to the connecting elements 30 or 34, has six equi-angularly spaced grooves 84 each wide enough to receive two adjacent star points of the star-shaped cross-section of the connecting element. This makes insertion of the connecting elements 30 or 34 easier for younger children, as well as providing more room for the star points of the connecting elements to flex.

Another modification incorporated in the modified block 14 of FIG. 13 is the replacement of one of the grooves 20 with an integrally moulded half connecting element 86 similar to the half connecting elements 52, 54 mentioned in relation to FIGS. 10 to 12. This modification can also be applied to the triangular blocks 12, and enables at least some connections between blocks to be made without using the connecting elements 30 or 34.

Figure 14:
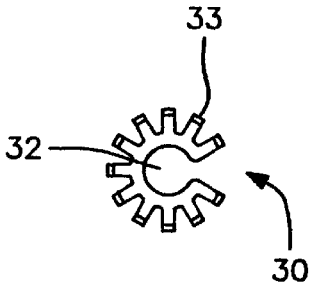
FIG. 14 is a top view of a modified version of the connecting element of FIG. 6.

FIG. 14 shows a modified version of the connecting element 34 of FIG. 6, in which a segment of the cross-section of the element comprising one of its twelve teeth is omitted altogether, thus rendering the cross-section generally C-shaped. This has the effect of making the connecting element even more flexible and crushable, and therefore even easier for young children to use.

Finally, the constructional toy of the present invention need not be moulded in plastics material. It can be made in wood, metal (such as extruded aluminium), ceramics (typically in the form of ceramic tiles) or concrete. Or for novelty or promotional purposes, it can even be moulded from chocolate, soap, ice, pasta or jelly.

I claim:

1. A constructional toy comprising a plurality of elements of at least two different types which can be assembled together to form a variety of three-dimensional structures, said elements including:

a main element in the form of a building block having a plurality of flat side surfaces, at least one of said surfaces having a groove therein, said groove having a mouth narrower than the remainder thereof; and an elongate connecting element having a cross-section in the shape of a symmetrical star having 2N points, where N is an integer not less than three, said connecting element being a sliding fit in said groove, with any N adjacent points of its star-shaped cross-section trapped in the groove and the other N points disposed outside the groove.

2. A constructional toy as claimed in claim 1, wherein each connecting element is hollow.

3. A constructional toy as claimed in claim 1, wherein the opposite ends of each connecting element are slightly tapered.

4. A constructional toy as claimed in claim 1, wherein N is six.

5. A constructional toy as claimed in claim 1, wherein N is four.

6. A constructional toy as claimed in claim 1, wherein each groove is shaped to be substantially complementary in cross-section to the cross-sectional shape of any N adjacent points of the star-shaped cross-section of the connecting element.

7. A constructional toy as claimed in claim 1, wherein each main element has first and second substantially planar, parallel, ends which are interconnected by said side surfaces.

8. A constructional toy as claimed in 7, wherein each of said side surfaces extends perpendicularly to said ends.

9. A constructional toy as claimed in claim 1, wherein each main element has a cross-section, perpendicular to said side surfaces, in the shape of a regular polygon.

10. A constructional toy as claimed in claim 9, wherein some main elements are triangular in cross-section.

11. A constructional toy as claimed in claim 9, wherein some main elements are square in cross-section.

12. A constructional toy as claimed in claim 11, wherein said side surfaces of the square main elements are all of the same width.

13. A constructional toy as claimed in claim 1, wherein each main element has at least one aperture extending thereinto with its axis parallel to the longitudinal axis of the groove, the aperture either being generally complementary in cross-sectional shape to the connecting element, or cylindrical with a diameter such that said connecting element is a tight sliding fit therein.

14. A constructional toy as claimed in 13, wherein the axis of the cylindrical aperture coincides with the central axis of the element.

15. A constructional toy as claimed in claim 1, wherein the main elements are all hollow with one of said planar ends closed and the other open.

16. A constructional toy as claimed in claim 1, further including auxiliary connecting elements each based upon a half connecting element constituted by the half of a complete connecting element on one side of a plane which longitudinally bisects the complete connecting element and the respective opposed included angles between opposed pairs of adjacent points of its cross-section.

17. A constructional toy as claimed in claim 16, wherein said auxiliary connecting element comprises two half connecting elements integrally joined at the respective midpoints of their respective flat sides and extending at 90° to each other.

18. A constructional toy as claimed in claim 16, wherein said auxiliary connecting element comprises a single half connecting element having a complete connecting element integrally joined thereto and extending perpendicularly from the midpoint of its flat side.

19. A constructional toy as claimed in claim 16, wherein said auxiliary connecting element comprises four connecting elements connected together at their ends and extending at right angles to each other in a common plane to form a cross.

20. A constructional toy as claimed in claim 1, wherein all the elements are made from a suitable plastics material.

21. A constructional toy as claimed in claim 20, wherein the elements are moulded from a plastics material selected from ABS, acrylic plastic, polystyrene or polypropylene.

22. A constructional toy as claimed in claim 20, wherein the plastics material is a foam plastics material.

23. A constructional toy as claimed in claim 22, wherein said foam plastics material is expanded polyethylene.

24. A constructional toy comprising a plurality of elements of at least two different types which can be assembled together to form a variety of three-dimensional structures, said elements including:

a main element in the form of a building block having a plurality of flat side surfaces, at least one of said surfaces having a groove therein;

an elongate connecting element having a cross-section in the shape of a symmetrical star having 2N points, where N is an integer not less than three, said connecting element being a sliding fit in said groove, with any N adjacent points of its star-shaped cross-section trapped in the groove and the other N points disposed outside the groove; and each connecting element being hollow, with its internal cross-section generally similar to its external cross-section, to render the connecting elements at least slightly crushable.

25. A constructional toy comprising a plurality of elements of at least two different types which can be assembled together to form a variety of three-dimensional structures, said elements including:

a main element in the form of a building block having a plurality of flat side surfaces, at least one of said surfaces having a groove therein, the ends of the grooves in each main element being slightly flared; and an elongate connecting element having a cross-section in the shape of a symmetrical star having 2N points, where N is an integer not less than three, said connecting element being a sliding fit in said groove, with any N adjacent points of its star-shaped cross-section trapped in the groove and the other N points disposed outside the groove.

26. A constructional toy comprising a plurality of elements of at least two different types which can be assembled together to form a variety of three-dimensional structures, said elements including:

a main element in the form of a building block having a plurality of flat side surfaces, at least one of said surfaces having a groove therein; and an elongate connecting element having a cross-section in the shape of a symmetrical star having 2N points, where N is an integer not less than three, said connecting element being a sliding fit in said groove, with any N adjacent points of its star-shaped cross-section trapped in the groove and the other N points disposed outside the groove;

each groove being shaped substantially complementary in cross-section to the cross-sectional shape of any N adjacent points of the star-shaped cross-section of the connecting element;

some main elements being triangular in cross-section;

some main elements being square in cross-section;

said side surfaces of the triangular main elements and the square main elements being all of a same width.

* * * * *